United States Patent [19]

Baba et al.

[11] 4,412,716

[45] Nov. 1, 1983

[54] SOCKET FOR BASELESS INCANDESCENT LAMP

[75] Inventors: Masaharu Baba, Yokohama; Kiyokazu Honda, Zushi, both of Japan

[73] Assignee: Tokyo Shibaura Denki Kabushiki Kaisha, Kawasaki, Japan

[21] Appl. No.: 173,752

[22] Filed: Jul. 30, 1980

[30] Foreign Application Priority Data

Aug. 1, 1979 [JP] Japan ..... 54-97241

[51] Int. Cl.[3] ..... H01R 13/48

[52] U.S. Cl. ..... 339/176 L

[58] Field of Search ..... 339/176 L

[56] References Cited

U.S. PATENT DOCUMENTS 3,950,061 4/1976 Kausen ..... 339/176 L X
4,114,972 9/1978 Kraus et al. ..... 339/176 L X
4,171,497 10/1979 Shinoda .

FOREIGN PATENT DOCUMENTS 2343999 3/1975 Fed. Rep. of Germany ... 339/176 L
2506942 9/1975 Fed. Rep. of Germany .
2025162 1/1980 United Kingdom .

*Primary Examiner*—Joseph H. NcGlynn
*Attorney, Agent, or Firm*—Cushman, Darby & Cushman

[57] ABSTRACT

A socket for holding a baseless incandescent lamp to be in electrical contact with terminals of said incandescent lamp, includes a socket body having a receiving cavity with a rectangular section into which a squeezed portion of said baseless incandescent lamp is to be fitted, a pair of terminal members attached to said socket body and to be brought in electrical contact with the terminals of said incandescent lamp when the squeezed portion of said incandescent lamp is fitted in said receiving cavity, and two pairs of ribs formed as a unit with said socket body and protruding from a facing pair of inner side faces of the receiving cavity of said socket body so that the projected ends of said ribs may elastically engage said squeezed portion in the vicinity of an exhaust tube of the lamp, the projected ends of two among said ribs squeezing themselves between said exhaust tube and the terminals of said incandescent lamp, thereby preventing said terminals from moving toward said exhaust tube.

13 Claims, 5 Drawing Figures

FIG. 1
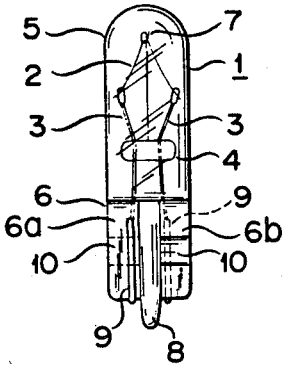
FIG. 2
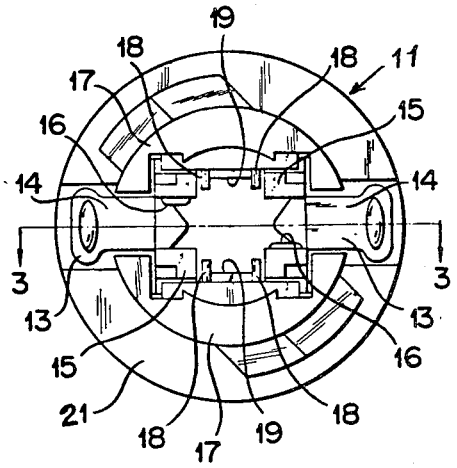
FIG. 3
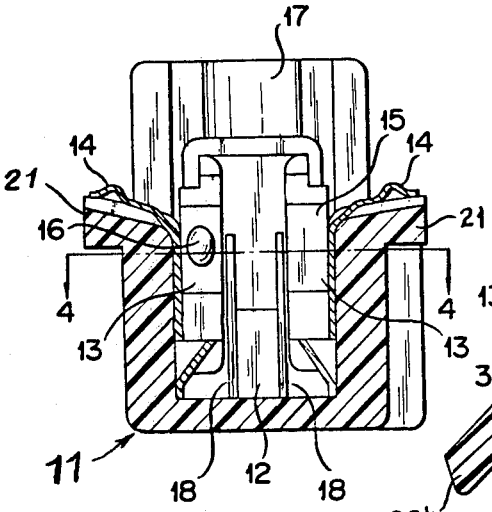
FIG. 4
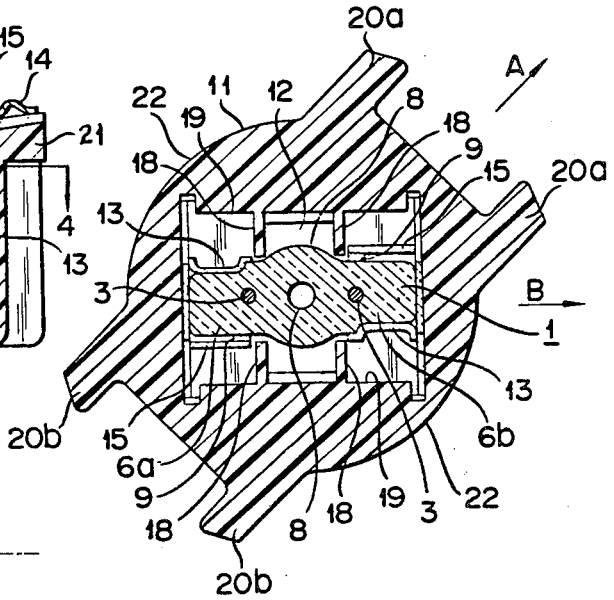
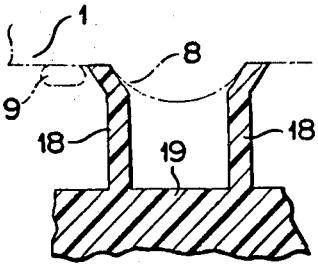
FIG. 5

SOCKET FOR BASELESS INCANDESCENT LAMP

This invention relates to a socket for electrically connectedly holding a miniature incandescent lamp, more specifically a baseless incandescent lamp, used for e.g. an indicator light.

Baseless incandescent lamps such as wedge-base lamps generally use an airtight container or bulb having quite a small outside diameter of 5 mm of thereabouts. The terminals of these lamps are not fixed to the squeezed portion thereof, with lead-in wires from the airtight container being only turned up along the outer surface of the squeezed portion. Consequently, the terminals are liable to move relatively to the socket contacts to cause faulty contact between them while and after the lamp is fitted into the socket.

Thus, it may be effective to prevent the movement of the terminals at the squeezed portion by thickening the walls of the socket on the sides where the socket contacts exist and making the section of a cavity to hold the squeezed portion of the lamp rectangular. If the wall thickness of the socket is to be locally varied, however, material will be drawn up to the thickened wall portions to make the section of the cavity rhombic at molding, impairing the ease of the insertion of the squeezed portion of the baseless incandescent lamp.

Accordingly, the object of this invention is to provide a high-yield socket for baseless incandescent lamp capable of holding a baseless incandescent lamp without causing faulty contact with the terminals of the lamp.

In an aspect of the present invention there is provided a socket for holding a baseless incandescent lamp to be in electrical contact with terminals of said incandescent lamp, said baseless incandescent lamp comprising a light transmitting container having a squeezed portion with an exhaust tube, a filament contained in said container, and a pair of lead-in wires each having one end connected to said filament and the other extending to the outside through said squeezed portion so that said pair of lead-in wires may be turned up along the squeezed surfaces of said squeezed portion to form terminals, comprising:

a socket body having a receiving portion with a rectangular section into which the squeezed portion of said baseless incandescent lamp is to be fitted;

a pair of terminal members attached to said socket body and to be brought in electrical contact with the terminals of said incandescent lamp when the squeezed portion of said incandescent lamp is fitted in said receiving portion; and two pairs of ribs formed as a unit with said socket body and protruding from a facing pair of inner side faces of the receiving portion of said socket body so that the projected ends of said ribs may elastically engage said squeezed portion in the vicinity of said exhaust tube, the projected ends of two among said ribs squeezing themselves between said exhaust tube and the terminals of said incandescent lamp, thereby preventing said terminals from moving toward said exhaust tube.

This invention can be more fully understood from the following detailed description when taken in conjunction with the accompanying drawings, in which:

FIG. 1 is a front view showing an example of a baseless incandescent lamp;

FIG. 2 is a plan view of a socket for baseless incandescent lamp according to an embodiment of this invention;

FIG. 3 is a sectional view of the socket as taken along line 3—3 of FIG. 2;

FIG. 4 is a sectional view of the socket fitted with the baseless incandescent lamp as taken along line 4—4 of FIG. 3; and FIG. 5 is a sectional view showing a modified embodiment of ribs formed on the socket.

Now there will be described a socket for baseless incandescent lamp along with a baseless incandescent lamp to be fitted and held therein for the ease of understanding with reference to the accompanying drawings.

Referring now to FIG. 1, a baseless incandescent lamp 1 has a cylindrical, light-transmitting, airtight container or bulb 5 with an outside diameter of approximately 5 mm which contains a tungsten filament 2. Both ends of the filament 2 are connected to and held by one ends of two lead-in wires 3, severally. These lead-in wires 3 are fixed inside the container 5 by means of a glass bead 4, and the other ends of the lead-in wires 3 are led to the outside, passed through and supported by a squeezed portion 6 of the container 5. In FIG. 1, numeral 7 designates a support supporting the filament 2, and numeral 8 designates an exhaust tube with one end sealed after the container 5 is once exhausted and then filled with gas. The squeezed portion 6 has a substantially rectangular section which is divided into lefthand and righthand halves *6a* and *6b* by the exhaust tube 8 located therebetween. The lead-in wires 3 are turned up respectively on the front side of the lefthand half *6a* and the back side of the righthand half *6b*, extending along these sides to terminate thereon. On the back side of the lefthand half *6a* and the front side of the righthand half *6b* of the squeezed portion 6, there are formed fixing grooves extending along the exhaust tube 8 in the vicinity thereof.

FIGS. 2 and 3 show a socket according to an embodiment of this invention. The socket includes a socket body 11 having a receiving portion 12 in the form of a cavity with a substantially square section defined in the central part of the socket body. The socket body 11 is formed by molding insulating synthetic resin such as black nylon. A pair of terminal members 13 formed of conductive metal such as phosphor bronze are fitted in the receiving portion 12 at a given space from each other. Each terminal member 13 is formed of a single bent strip, including a terminal strip 14 to be connected to the power source terminal of a device (printed substrate, not shown) coupled with an external power source and a contact strip 15 adjacent to the terminal strip 14 and to be brought in electrical contact with a terminal 9 of the baseless incandescent lamp 1 shown in FIG. 1. On the inner side base of the receiving portion 12 of the socket body 11, there are formed a pair of projections 16 each of which engages the groove 10 of the baseless incandescent lamp 1 to prevent transverse movement of the lamp 1 when the lamp 1 is fitted into the receiving portion 12. A flange 21 is formed on the central part of the periphery of the socket body 11, the terminal strip 14 extending to the top of the flange 21. A portion of the socket body 11 located above the flange 21 is substantially cylindrical. The cylindrical upper portion is divided into two parts by a slit to form guides 17 for the insertion of the baseless incandescent lamp 1. From each of a parallel facing pair of inner side faces 19 of the receiving portion 12 of the socket body 11 located below the flange 21 protrude a pair of ribs 18 extending vertically along the inner side face 19 and projected at right angles to the face 19. As clearly shown in FIG. 4, these ribs 18 are formed as a unit with the socket body 11 so that they may engage the boundaries between the exhaust tube 8 and the lefthand and righthand halves 6a and 6b of the squeezed portion 6 of the baseless incandescent lamp 1 when the squeezed portion 6 is fitted in the receiving portion 12. The four ribs 18, formed in this manner, have a function to prevent distortion of the socket body 11 at molding, two of them preventing the terminals 9 of the lamp 1 from moving toward the exhaust tube 8 to cause contact fault.

Since surfaces of the squeezed portion 6 of the baseless incandescent lamp 1 at right angles to its squeezed faces, i.e. the left and right end faces of the squeezed portion, is substantially in contact with facing inner side faces of the receiving portion 12, the terminal 9 will never move in the opposite direction to the exhaust tube 8 to slip off the squeezed surfaces, and contact fault due to the shifting of the terminals 9 in such direction will be able to be prevented.

Two pairs of pinch ribs 20a and 20b protrude from the outer peripheral sides of the socket body 11 at the cylindrical portion below the flange 21. Each pair of these ribs protrude in the same direction and in parallel with each other, and in the opposite direction to their counterparts on the other side. Thus, the lower portion of the socket body 11 constitutes a substantially rectangular grip portion having a pair of wide pinch faces 22. The protruding direction A of these ribs 20a and 20b is neither perpendicular to nor coincident with the width direction B of the squeezed portion 6 of the baseless incandescent lamp 1, making an angle of approximately 45° with the direction B in the example of FIG. 4. This is so because if the directions A and B are identical, with a miniature lamp, the terminals 14 of the socket will possibly pass the electrodes of the printed substrate when the socket is turned at a given angle to be mounted on the printed substrate. Socket walls between the four corners of the receiving portion 12 and the outer peripheral surface of the socket body 11 have the same thickness.

Although the ribs 18 formed in the receiving portion 12 have an oblong section in the above-mentioned embodiment, their tip end portions may be bent so as to extend along the outer peripheral surface of the exhaust tube 8, as shown in FIG. 5. Also in this case, it is necessary to make the ribs 18 thin (elongate) enough to have elasticity.

In a prior art socket for baseless incandescent lamp having no ribs in the receiving portion, the terminals 9 formed of the lead-in wires 3 of the baseless incandescent lamp 1 turned up at the end portion of the squeezed portion are allowed to move and may possibly slip off the squeezed surfaces, so that the contact between the terminals of the lamp and the contact strips of the socket may become unstable or the lamp may fail to light up. In the socket of this invention, however, the terminals 9 are kept from slipping off from the squeezed surfaces to the exhaust tube 8 side by the ribs 18 integral with the receiving portion 12, so that the contact fault can be prevented.

Although the ribs 18 protrude from the inner side faces of the receiving portion 12 at right angles thereto in the above-mentioned embodiment, the angle of protrusion is not limited to 90° and may vary within a range of 90°±30°.

What we claim is:

1. A socket for holding and effecting electrical contact with the terminals of a baseless incandescent lamp of the type comprising a light transmitting container having a squeezed portion with an exhaust tube, a filament contained in said container, and a pair of lead-in wires each having one end connected to said filament and the other extending to the outside through said filament and the other extending to the outside through said squeezed portion so that said pair of lead-in wires may be turned up along the squeezed surfaces of said squeezed portion to form terminals, said socket comprising:

a socket body having a receiving portion defining a rectangular section including an opposing pair of inner side faces for receiving the squeezed portion of said baseless incandescent lamp;

a pair of terminal members attached to said socket body for effecting electrical contact with said terminals of said incandescent lamp when said squeezed portion of said incandescent lamp is received in said receiving portion; and first and second symmetrical pairs of ribs integrally formed with said socket body, said first pair protruding from a predetermined one of said inner side faces, and said second pair protruding from the other of said inner side faces, said first and second pairs disposed in said receiving portion intermediate said exhaust tube and said terminals when said incandescent lamp is received in said receiving portion, the projected edges of said ribs elastically engaging said squeezed portion in the vicinity of said exhaust tube, the projected edges of each set of diagonally opposing ribs of said first and second rib pairs capable of being disposed between said exhaust tube and the terminals of said incandescent lamp regardless of lamp orientation upon insertion into said receiving portion, thereby preventing said terminals from moving toward said exhaust tube.

2. A socket according to claim 1, wherein the receiving portion of said socket body is a recess with a substantially square section which is defined by said pair of inner side faces and another pair of inner side faces at right angles to said first mentioned inner said faces, said other pair of inner side faces severally engaging end faces of the squeezed portion of said baseless incandescent lamp substantially perpendicular to said squeezed surfaces.

3. A socket according to claim 2, wherein each pair of said two pairs of ribs protrude from each inner side face, extending in parallel with each other at a given space.

4. A socket according to claim 3, wherein each of said ribs has an extended end bent to extend along the surface of the exhaust tube of said baseless incandescent lamp.

5. A socket according to claim 3, wherein each of said ribs is a strip-shaped rib having a rectangular cross-section the major axis of said rectangular cross-section forming a predetermined angle with said inner side face.

6. A socket according to claim 5, wherein said rib protrudes from said inner side face, said predetermined angle being within a range of 90°±30° to said inner side face.

7. A socket according to claim 1, wherein said socket body includes means defining a substantially rectangular grip portion having opposing pairs of outer side faces, the major axis of said rectangular grip portion forming an acute angle with the squeezed surfaces of the squeezed portion of said baseless incandescent lamp when fitted in said receiving portion.

8. A socket according to claim 7, wherein said acute angle between the major axis of said rectangular grip portion and said squeezed surfaces is 45°.

9. A socket according to claim 8, wherein the cross-sectional thicknesses of said socket body are equal in the area between the four corners of said receiving portion along a line defined by the intersection of said first mentioned inner side faces and said other side faces and the outer side faces of said socket body.

10. A socket for holding and effecting electrical contact with the terminals of a baseless incandescent lamp of the type comprising a light transmitting container having a squeezed portion with an exhaust tube, a filament enclosed in said container, and a pair of lead-in wires each having one end connected to said filament and the other end extending outside of said container through said squeezed portion and being turned up along the squeezed surfaces of said squeezed portion thereby forming terminals, said socket comprising:

a socket body including means defining a rectangular receiving portion for receiving the squeezed portion of said lamp therein;

a pair of terminal members attached to said socket body for effecting electrical contact with said terminals of said lamp; and first and second symmetrical and diagonally opposing sets of rib means integral with said socket body each set disposed on predetermined opposing surfaces of said receiving portion for elastically engaging said squeezing portion between said exhaust tube and said terminals of said lamp regardless of lamp orientation upon insertion into said receiving portion for preventing movement of said terminals toward said exhaust tube; and wherein said first and second rib means each includes a pair of identical cross-sectionally elongated rib members, the axis of elongation being disposed in a direction between said receiving portion and said squeezed portion.

11. A socket as in claim 10 wherein each of said first and second rib means include an angulated portion near said squeezed portion wherein said angulated portions of each of said rib member pairs are divergingly angulated with respect to one another.

12. A socket as in claim 10 wherein said socket body includes first and second opposing outer surface pairs and means defining grippable members formed on a predetermined one of said outer surface pairs.

13. A socket as in claim 12 wherein said grippable members include an enlongated first pair of horizontally separated parallel gripping fingers associated with one of said outer surfaces comprising said first outer surface pair, and an elongated second pair of horizontally separated parallel gripping fingers associated with the other of said outer surfaces comprising said first outer surface pair, said first and second gripping finger pairs having their axes of elongation angularly oriented with respect to the major axis of said rectangular receiving portion, wherein a line parallel to said axes of elongation of said first and second gripping fingers intersects said major axis forming an acute angle therewith.

* * * * *